United States Patent [19]

Fujiwara Tatsuo et al.

[11] 4,165,982

[45] Aug. 28, 1979

[54] MOLYBDENUM BASE ALLOY HAVING EXCELLENT HIGH-TEMPERATURE STRENGTH AND A METHOD OF PRODUCING SAME

[75] Inventors: Fujiwara Tatsuo, Nagoya; Koshi Katoh, Yokkaichi; Yuzo Ohtakara, Kagamihara; Takayoshi Shimizu, Ichinomiya, all of Japan

[73] Assignee: Daido Tokushuko Kabushiki Kaisha, Nagoya, Japan

[21] Appl. No.: 858,637

[22] Filed: Dec. 8, 1977

[30] Foreign Application Priority Data

Dec. 11, 1976 [JP] Japan ..... 51/149267

[51] Int. Cl.[2] ..... C22C 27/00; C22F 1/18

[52] U.S. Cl. ..... 75/176; 75/65 EB

[58] Field of Search ..... 75/176, 65 EB

[56] References Cited

U.S. PATENT DOCUMENTS

| | | | |
|---|---|---|---|
| 2,960,403 | 11/1960 | Timmons et al. | 75/176 |
| 3,169,860 | 2/1965 | Semchyshen | 75/176 |
| 3,243,291 | 3/1966 | Dickinson et al. | 75/176 |
| 3,361,599 | 1/1968 | Bargainnier et al. | 148/11.5 |

OTHER PUBLICATIONS

Fromm et al., "Equilibria in Mo-N Solid Solutions" Z. Metallkde, 62 1971, 373.

Prekel et al., "Innovations in E. B. Zone Refining Mo" in Electron & Ion Beams—Tech. vol. I, AIME, N. Y. 1965.

Witzke, "- - - HfC-Strengthened Mo-Alloys" Met. Trans. A, 7 (1976) 443.

*Primary Examiner*—L. Dewayne Rutledge
*Assistant Examiner*—Upendra Roy
*Attorney, Agent, or Firm*—Fleit & Jacobson

[57] ABSTRACT

A molybdenum base alloy containing a given amount of at least one of zirconium and hafnium, a given amount of carbon and not more than given amounts of oxygen and nitrogen has an excellent high-temperature strength. This alloy is produced by an electron beam melting process under high vacuum.

6 Claims, 8 Drawing Figures

MOLYBDENUM BASE ALLOY HAVING EXCELLENT HIGH-TEMPERATURE STRENGTH AND A METHOD OF PRODUCING SAME

BACKGROUND OF THE INVENTION

1. Field of the Invention

The present invention relates to a molybdenum base alloy having high-temperature strength and a method of producing the same. More particularly, the present invention relates to a molybdenum base alloy having high-temperature strength, which contains a given amount of at least one of zirconium and hafnium, a given amount of carbon, and further contains not more than given amounts of oxygen and nitrogen, and a method of producing the same.

2. Description of the Prior Art

Metallic molybdenum has excellent high-temperature strength, and it is known that molybdenum base alloy containing carbon and alloy elements, such as Ti, Zr, Hf and the like, has better high-temperature strength than that of metallic molybdenum. The reason why the molybdenum base alloy has better high-temperature strength than that of metallic molybdenum is considered to be as follows. The carbide formed by the addition of the above described alloy elements to metallic molybdenum suppresses the grain boundary migration or causes precipitation hardening to raise the recrystallization temperature, that is, softening temperature, and the decrease of the strength of the alloy is small even at high temperature.

However, in order to raise the above described recrystallization temperature, a relatively large amount of alloy elements has hitherto been added to molybdenum, and for example, Zr is added to molybdenum so that the resulting molybdenum base alloy contains at least 0.03% by weight of Zr, and Hf is added to molybdenum so that the alloy contains at least 0.05% by weight of Hf. Addition of such an amount of Zr or Hf to molybdenum raises the recrystallization temperature of the resulting molybdenum base alloy, but the malleability, ductility and workability thereof are poor.

Molybdenum or molybdenum base alloy has hitherto been mainly produced by the powder metallurgy process or vacuum arc melting process.

In general, in the powder metallurgy process, a powdery raw material mixture of molybdenum and alloy elements or the compounds thereof is press molded, and the molded article is heated and sintered at about 1,700° C. The resulting alloy is subjected to swaging or other working to be made into a malleable material. In the powder metallurgy process, molybdenum is alloyed by the diffusion or penetration of particles of alloy elements or the compound thereof into molybdenum, and therefore it is very difficult to obtain molybdenum base alloys having a homogenous microscopic composition. Accordingly, when a mixture of metallic molybdenum powder and finely divided compounds, such as oxide, carbide and nitride, which are hardly soluble in the molybdenum matrix, is press molded and the molded article is heated and sintered, a molybdenum base alloy containing foreign substance phase particles dispersed therein can be obtained. The foreign substance phase particles prevent the grain boundary migration at the recrystallization treatment of the alloy and suppresses the recrystallization of the molybdenum matrix. Therefore, in the powder metallurgy process, even metal oxides, which are chemically stabler than molybdenum oxide and can maintain the solid phase at the sintering temperature or working temperature of molybdenum, can be used as foreign substance phase particles. This phenomenon is the same as in the case of metal nitride and carbide.

The vacuum arc melting process also is used in the melting of molybdenum or molybdenum base alloy. High-strength molybdenum base alloy is an alloy containing Ti together with at least one of Zr and Hf.

However, among the molybdenum base alloys produced by the powder metallurgy process or vacuum arc melting process, the higher tensile strength an alloy has, a higher temperature is necessary in the hot working of the alloy and therefore the workability thereof is poorer.

SUMMARY OF THE INVENTION

Figure 1:
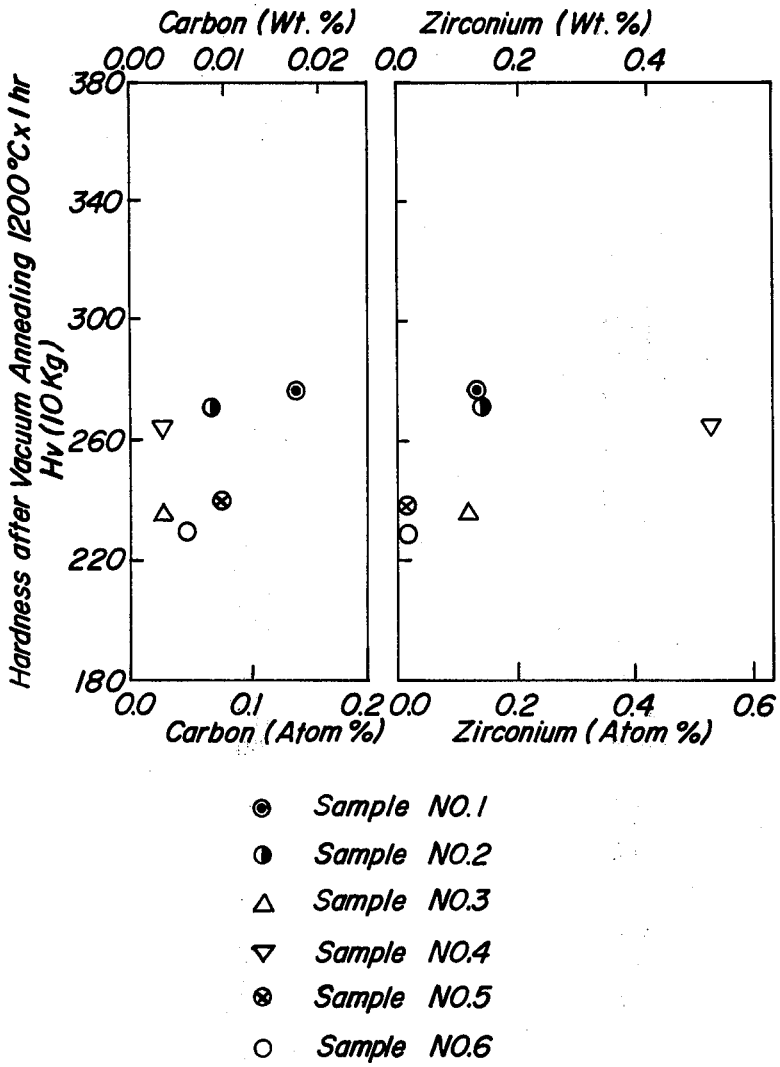
FIG. 1 shows the relationships between the hardness of an annealed Mo—Zr—C series alloy and the amount of carbon or zirconium contained in the alloy.

The object of the present invention is to provide a molybdenum base alloy having an excellent high-temperature strength, which is free from the drawbacks of poor malleability, ductility and workability in the commonly known molybdenum base alloy containing Ti, Zr and Hf.

Another object of the present invention is to provide a method of producing the above described molybdenum base alloy.

That is, one of the features of the present invention is the provision of a molybdenum base alloy having an excellent high-temperature strength, which consists of 0.005–0.015% by weight of C, at least one of 0.002–0.02% by weight of Zr and 0.004–0.04% by weight of Hf, not more than 0.0015% by weight of oxygen, not more than 0.0010% by weight of nitrogen and the remainder being substantially Mo.

Another feature of the present invention is the provision of a method of producing the above described molybdenum base alloy, comprising melting a raw material mixture consisting of metallic molybdenum, at least one of predetermined amounts of Zr and Hf and a predetermined amounts of C, or a raw material mixture consisting of metallic molybdenum, a predetermined amount of at least one of ZrC and HfC and a predetermined amount of C with an electron beam with an overall energy consumption of at least 8 kw·hr/kg—Mo under a pressure of not higher than $1\times10^{-4}$ mmHg.

The term "predetermined amount of alloy element" in the specification and claims means the necessary amount of the element counting on loss of the element at melting.

DETAILED DESCRIPTION OF THE INVENTION

Alloys are widely known Mo-Ti-Zr as molybdenum base alloys. A typical example of the Mo-Ti-Zr alloys is one sold by Climax Molybdenum Co., U.S.A. under the trademark TZM, which consists of 0.4–0.55% by weight of Ti, 0.06–0.12% by weight of Zr, 0.01–0.04% by weight of C and the remainder being Mo and has an elongation of at least 10%.

carbides is small. This seems to be the reason why the usefulness of titanium family addition less than 0.05% has not been observed. Accordingly, the inventors have newly found out that, in a molybdenum base alloy containing a very small amount of oxygen and nitrogen, even when the total amount of Ti, Zr and Hf contained in the alloy is small, the precipitation hardening phenomenon occurs effectively due to the presence of TiC, ZrC or HfC to raise the recrystallization temperature, and accomplished the present invention.

As molybdenum base alloys having excellent high-temperature strength, alloys having a composition as shown, for example, by sample Nos. A, B, C, D and E in the following Table 1 are known.

Table 1

| | Sample No. | C (wt.%) | 0 (wt.%) | N (wt.%) | Zr (wt.%) | Hf (wt.%) | Ti (wt.%) | Elongation* (%) |
|---|---|---|---|---|---|---|---|---|
| Alloy of the present invention | 5 | 0.010 | <0.0005 | <0.0005 | 0.0067 | — | — | 21 |
| | 6 | 0.006 | <0.0005 | <0.0005 | 0.0037 | — | — | 20 |
| | 7 | 0.007 | 0.0009 | 0.0006 | — | 0.0280 | — | 13 |
| | 12 | 0.009 | 0.0011 | <0.0005 | 0.0043 | 0.0100 | — | 15 |
| Comparative alloy | A | | | | 0.0800 | — | 0.5 | 15.5 |
| | B | 0.022 | | | 0.0500 | — | — | 13 |
| | C | 0.019 | | | 0.0700 | — | 0.5 | 13.5 |
| | D | 0.24 | | | — | 0.09 | | 12 |
| | E | 0.42 | | | — | 0.18 | | 4 |

*Elongation was measured after stress-relief annealing.

There is described in Journal of Metals, 1971, No. 6, pages 27–38 that a molybdenum base alloy containing 0.2–1.0 mol% of HfC has a very high ultimate tensile strength, and the alloy containing 0.98% by weight of Hf and 1.11% by weight of C has the highest strength, which is higher than that of the above described TZM. Further, the above described literature references discloses a relation between the composition and strength of a molybdenum base alloy containing 0.09–1.83% by weight of Hf and 0.24–1.19% by weight of C.

The paper "Mechanical Properties of Molybdenum or Molybdenum Base Alloy Plate" in No. 272 of Symposium on Newer Metals, Special Technical Publication published by American Society for Testing Material in 1959 discloses a relation between the Zr and C contents in a molybdenum base alloy and the secondary recrystallization temperature thereof, and further discloses that molybdenum base alloys containing 0.05% by weight of Zr together with 0.022% by weight or 0.053% by weight of C have a high-temperature strength respectively, and the alloy plate containing 0.053% by weight of C has superior malleability over the alloy plate containing 0.022% by weight of C.

The inventors have made various investigations with respect to the relation between the Ti, Zr or Hf content in the commonly known molybdenum base alloy and the mechanical properties of the alloy at high temperature in order to improve the mechanical properties of commonly known molybdenum and molybdenum base alloy at high temperature, and noticed that there is no relationship between the degree of resistance to recrystallization and the Ti, Zr and Hf contents in the alloy as explained later, but Ti, Zr and Hf are effective if carbon coexists in enough amount to form TiC, ZrC or HfC. Since commonly known molybdenum base alloy contains a relatively large amount of oxygen and nitrogen, very small addition of Ti, Zr and Hf to molybdenum does not seem to be effective in raising the recrystallization temperature of molybdenum, because oxides of these metals are firstly formed, and therefore the total amount of Ti, Zr and Hf available for the formation of It can be seen from Table 1 that the Zr, Ti or Hf content in these commonly known molybdenum base alloys is remarkably higher than the Zr or Hf content in the molybdenum base alloys of the present invention, and is as high as about 7–22 times of the Zr or Hf content in the alloy of the present invention, for example, shown in sample Nos. 5, 6, 7 and 12 in Table 1.

Further, it can be seen from Table 1 that, although commonly known alloy sample Nos. A–E have remarkably higher Zr, Hf, or Ti content than the alloy samples 5, 6, 7 and 12 of the present invention, the alloy samples A–E are somewhat lower in elongation than alloy samples 5, 6, 7 and 12.

Figure 6:
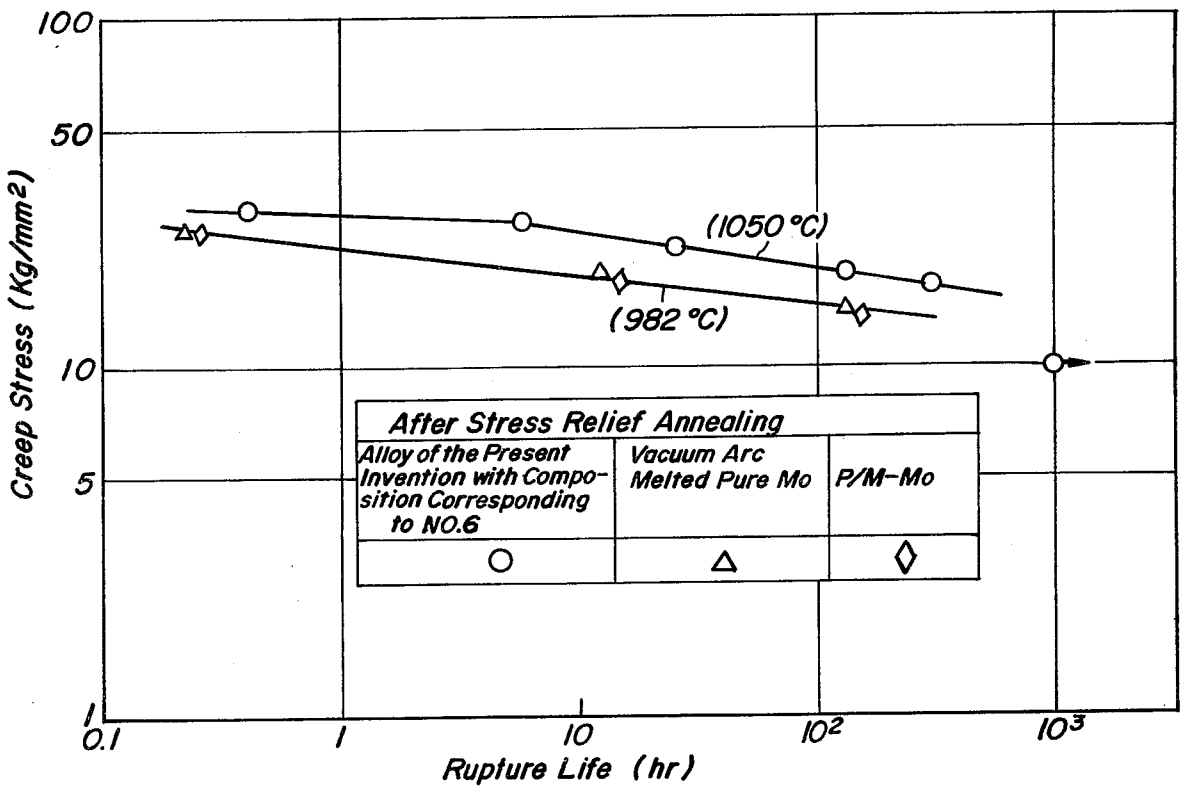
FIG. 6 shows creep-rupture strength curves of molybdenum base alloys and pure molybdenum.

A comparison of the alloy sample of the composition corresponding to sample No. 6 of the present invention with two types of pure molybdenum in the creep rupture test is shown in FIG. 6. The data for the pure molybdenum is from: R. O. Barr; "Creep Rupture Data on Unalloyed Molybdenum from 1,000° F. to 2,000° F," Research Proj. 22, Metallurgy of Molybdenum Base Alloys, Assignment No. 1957–5 Dec. 3, 1958). It can be seen in FIG. 6 that, although the creep rupture test is carried out at a higher temperature of about 70° C., the alloy sample is superior to pure molybdenum in the rupture stress. Namely, in the present invention, the high-temperature strength of molybdenum has been improved by alloying the molybdenum with a very small amount of alloy elements.

That is, the inventors have newly found out that, when a very small amount of at least one of Zr and Hf is added to molybdenum containing a sufficient amount of carbon, and a very small amount of oxygen and nitrogen to alloy the molybdenum, the resulting alloy causes precipitation hardening and has a recrystallization temperature higher than that of molybdenum.

The production method of the molybdenum base alloy of the present invention will be explained next.

The inventors have made various investigations with respect to the method of producing molybdenum base alloy and noticed that the necessary amount of carbides of Ti, Zr and Hf required for causing the above described precipitation hardening cannot be obtained unless a large amount of Ti, Zr and Hf is used in the above described powder metallurgy process and vacuum arc melting process, and found out that, since the oxygen and nitrogen contents in the alloy cannot be fully decreased by the above described conventional methods, the Ti, Zr and Hf contained in the alloy are firstly reacted with the oxygen and nitrogen to form their oxide and nitride and the remaining Ti, Zr and Hf are reacted with C to form TiC, ZrC and HfC during the fabrication of the alloy.

Based on the above observation, the inventors made the following tests with respect to the production of molybdenum base alloy by the electron beam melting process.

In the first test, a sample block of molybdenum base alloy having the same composition as that of molybdenum alloy TZM, which consists of 0.01–0.03% by weight of C, 0.5% by weight of spongy Ti, 0.08% by weight of spongy Zr and the remainder being Mo, was melted by an electron beam. In this case, when the energy input exceeds about 10 kw·hr/kg—Mo, Zr remained in the alloy in a high yield, but Ti remained in the alloy in a low yield of at most 0.01%, and it has been found that it is difficult to leave a desired amount of Ti in the alloy.

In the second test, a pressed compact of molybdenum base alloy produced from a mixture of molybdenum powder and TiC powder was melted by the electron beam. In this case, the yield of the Ti was much higher than in the first case, but less than 30%.

It can be seen from the results of the above described experiments that commonly known high-strength molybdenum base alloy contains Ti, and it is not easy to produce a molybdenum base alloy containing a predetermined amount of Ti by the electron beam melting process, and therefore the electron beam melting process is not suitable for the production of such alloy.

Based on the above experience and the following phenomenon that oxygen and nitrogen contained in an alloy can be fully removed by melting the alloy by an electron beam under high vacuum, and Zr and Hf do not volatilize contrary to Ti and remain in the alloy, the inventors have found out a novel method of producing the alloy containing no Ti of the present invention by electron beam melting under high vacuum.

According to the present invention, a novel molybdenum base alloy having an excellent high-temperature strength, which consists of 0.005–0.015% by weight of C, at least one of 0.002–0.02% by weight of Zr and 0.004–0.04% by weight of Hf, not more than 0.0015% by weight of oxygen, not more than 0.0010% by weight of nitrogen and the remainder being substantially Mo, can be produced by melting a raw material mixture consisting of metallic molybdenum, at least one of predetermined amounts of Zr and Hf and a predetermined amount of C, or a raw material mixture consisting of metallic molybdenum, a predetermined amount of at least one of ZrC and HfC and a predetermined amount of C, by means of an electron beam with an overall input energy of at least 8 kw·hr/kg-Mo under a pressure of not higher than $1\times10^{-4}$ mmHg.

The present invention will be explained in more detail referring to experimental data.

A raw material mixture for Mo—Zr—C series alloy or Mo—Hf—C series alloy was melted and cast into an alloy block having a chemical composition shown in the following Table 2 in an electron beam melting furnace having a maximum melting capacity of 150 kg, a maximum electron beam power output of 300 kw and a maximum vacuum degree of $1\times10^{-6}$ mmHg. The cast alloy block having a thickness of 12 mm and a width of 50 mm was heated at a temperature of not higher than 1,400° C., hot rolled into a thickness of 1.5 mm, finishing at a temperature of not lower than 1,000° C. Then, plate type tensile test pieces of gauge width 4.5 mm and thickness 1.0 mm and length 20 mm with mark distance for elongation measurement of 8.5 mm were machined. And these pieces were annealed under vacuum within the temperature range of 1,000°–1,500° C.

Tensile tests were conducted in an Instron type machine at a cross head speed of 1 mm/min at room temperature.

Table 2

| Sample No. | C (wt.%) | 0 (wt.%) | N (wt.%) | Zr (wt.%) | Hf (wt.%) | ZrC (mol%) | HfC (mol%) |
|---|---|---|---|---|---|---|---|
| 1 | 0.018 | 0.0010 | 0.0016 | 0.12 | — | 0.13 | — |
| 2 | 0.009 | 0.0012 | 0.0009 | 0.13 | — | 0.07 | — |
| 3 | 0.004 | 0.0005 | 0.0010 | 0.11 | — | 0.03 | — |
| 4 | 0.004 | 0.0005 | 0.0017 | 0.53 | — | 0.03 | — |
| 5* | 0.010 | <0.0005 | <0.0005 | 0.0067 | — | 0.0070 | — |
| 6* | 0.006 | <0.0005 | <0.0005 | 0.0037 | — | 0.0039 | — |
| 7* | 0.007 | 0.0009 | 0.0006 | — | 0.028 | — | 0.015 |
| 8 | 0.005 | 0.0008 | 0.0013 | — | 1.00 | — | 0.038 |
| 9 | 0.015 | 0.0012 | 0.0009 | — | 0.53 | — | 0.114 |
| 10** | 0.026 | 0.0010 | 0.0005 | — | — | — | — |
| 11*** | 0.004 | 0.0024 | 0.0042 | — | — | — | — |
| 12* | 0.009 | 0.0011 | <0.0005 | 0.0043 | 0.010 | 0.0045 | 0.0055 |

*Alloy of the present invention.
**Mo metal containing neither Zr nor Hf.
***Mo metal produced by powder metallurgy, which may be called as (P/M-Mo) metal.

Figure 2:
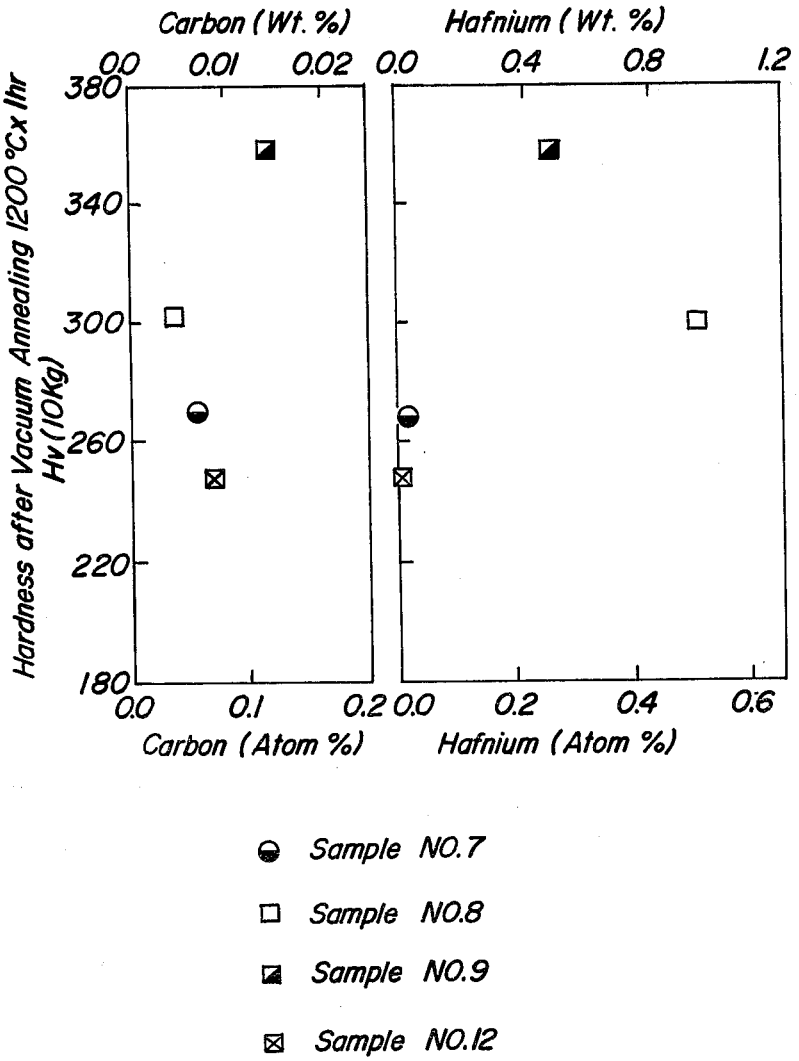
FIG. 2 shows the relationships between the hardness of an annealed Mo—Hf—C series alloy and the amount of carbon or hafnium contained in the alloy.
Figure 3:
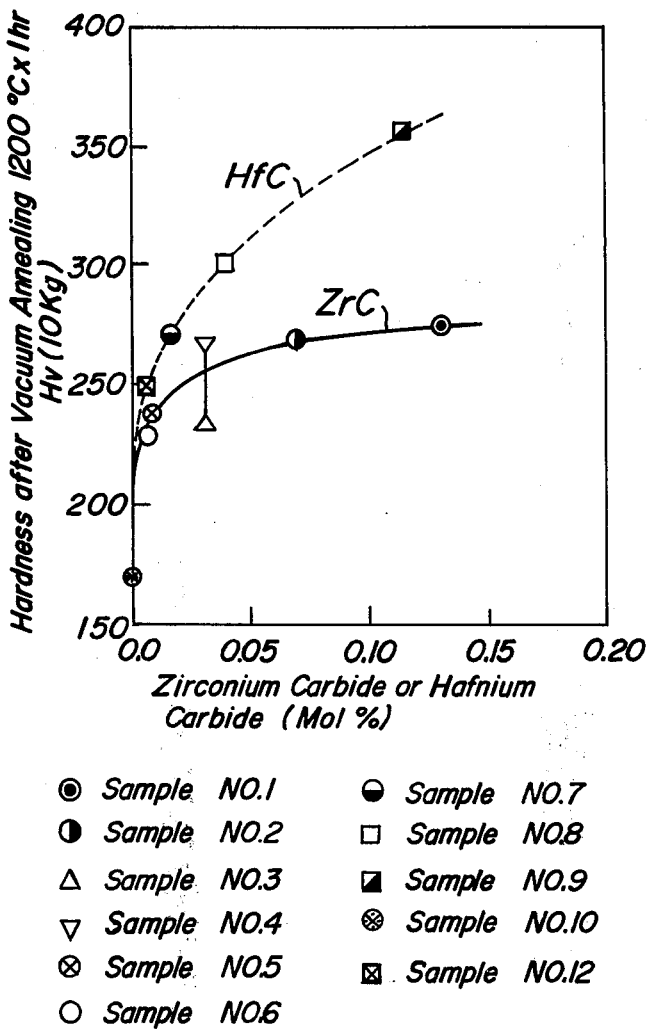
FIG. 3 shows the relationship between the hardness of an annealed Mo—Zr—C series alloy and the amount of zirconium carbide supposed to be contained therein, and a relation between the hardness of an annealed Mo—Hf—C series alloy and the amount of hafnium carbide supposed to be contained therein.

FIG. 1 shows the relationship between the hardness of the annealed alloy and the C or Zr content thereof when the vacuum annealing is carried out at 1,200° C. for 1.0 hour. FIG. 2 shows the relationship between the hardness of the annealed alloy and the C of Hf content thereof when the vacuum annealing is carried out at 1,200° C. for 1 hour. It can be seen from FIGS. 1 and 2 that there is no correlation between the hardness of the alloy and the C, Zr or Hf content thereof individually. However, there is a correlation between the ZrC or HfC content, which is assumed to be the smaller of the atomic percent of Zr or Hf and C, and the hardness of the alloy after the vacuum annealing, as shown in FIG. 3. Therefore, the inventors consider that the hardness of an alloy is influenced by the amount of zirconium carbide and hafnium carbide supposed to be formed therein during fabrication. That is, it is necessary that C coexists with Zr and/or Hf in an amount sufficient to form stoichiometrically ZrC and/or HfC in the alloy for the purpose of improving the hardness of the alloy. It can be seen from FIG. 3 that the high-temperature strength of Mo—Zr—C series alloy or Mo—Hf—C series alloy of the present invention can be improved by the use of a smaller amount of Zr or Hf than that used in the commonly known Mo—Zr—C series alloy or Mo—Hf—C series alloy.

Figure 4A:
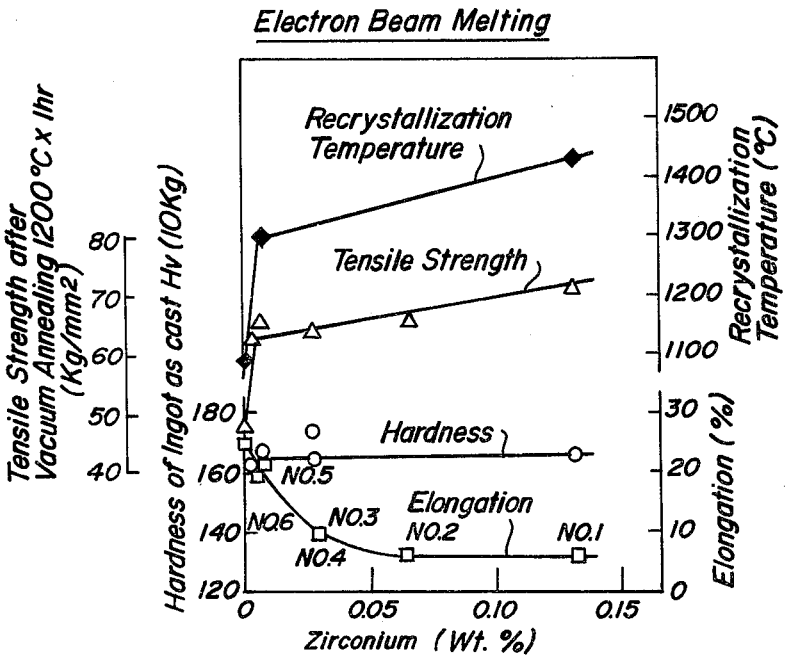
FIGS. 4A and B shows the influence of zirconium upon the mechanical properties of molybdenum in electron beam melting or vacuum arc melting.
Figure 4B:
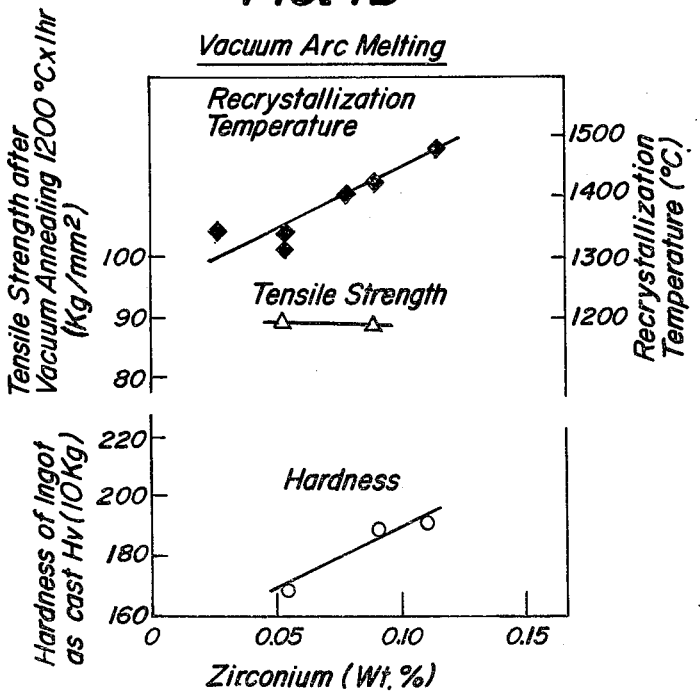
Figure 5A:
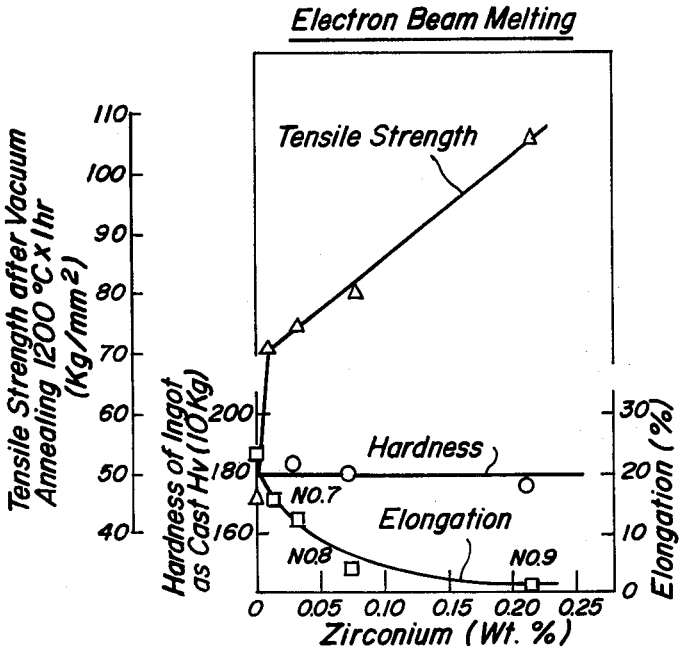
FIGS. 5A and B illustrate the influence of hafnium upon the mechanical properties of molybdenum in electron beam melting or vacuum arc melting.
Figure 5B:
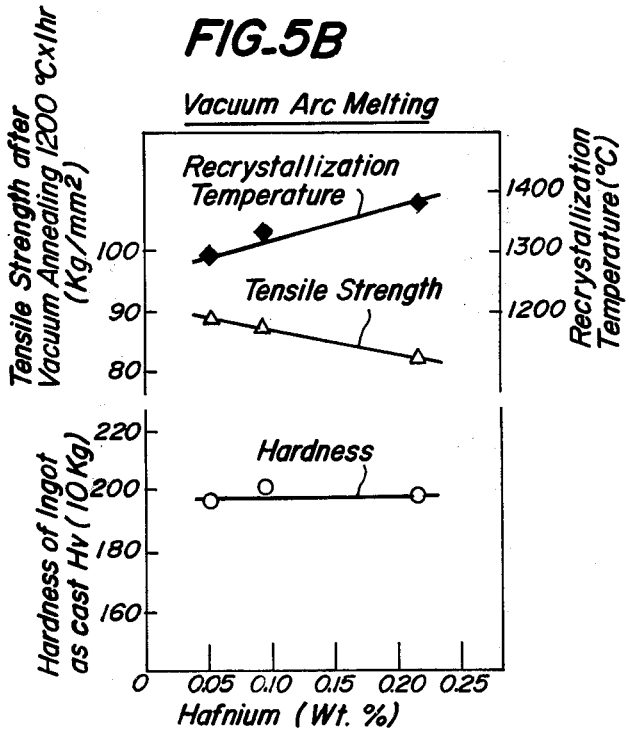

FIGS. 4 and 5 show relations between the properties, such as hardness of ingot as cast, tensile strength and recrystallization temperature, of alloy plate samples having the same thickness and the Zr or Hf content therein. Each of FIGS. 4 and 5 shows the above described relations in the molybdenum base alloy produced by the vacuum arc melting process (M. Semchyschen: The Metal Molybdenum (1949), The American Society for Metals) and in the molybdenum base alloy obtained by the electron beam melting process of the present invention. It can be seen from FIG. 4A that, when a very small amount of zirconium is added to pure metallic molybdenum, the resulting molybdenum base alloy has a much improved tensile strength. However, even when the alloy contains more than 0.02% by weight of zirconium, the alloy shows a small increase in its tensile strength and its elongation decreases by not more than 10%. Accordingly, the amount of zirconium to be contained in the molybdenum base alloy must be within the range of 0.002–0.02% by weight. It can be seen from FIG. 5A that the Hf content in the alloy must be within the range of 0.004–0.04% by weight in order that the alloy has an elongation of not lower than 10% and a tensile strength of at least 150% based on that of pure metallic molybdenum.

Further, a molybdenum base alloy containing both zirconium and hafnium (Table 2, sample No. 12) had a tensile strength of 80 kg/mm$^2$ and an elongation of 15% after vacuum annealing.

In the present invention, the amounts of the components to be contained in the molybdenum base alloy are limited based on the following reason.

When C is present in the molybdenum base alloy in an amount of less than 0.005% by weight, it is difficult to lower the oxygen content in the molybdenum base alloy to not higher than 0.0015% by weight, and to fabricate the ingots. While, when the amount of C contained in the alloy exceeds 0.015% by weight, the alloy has poor ductility. Therefore, the amount of C to be contained in the alloy must be within the range of 0.005–0.015% by weight.

When the amount of Zr contained in the alloy is less than 0.002% by weight, the amount of the resulting ZrC is too small to cause precipitation hardening. However, when the amount of Zr contained in the alloy is more than 0.02% by weight, the alloy has poor ductility. Therefore, the amount of Zr to be contained in the alloy must be within the range of 0.002–0.02% by weight.

When the amount of Hf contained in the alloy is less than 0.004% by weight, HfC is not formed in an amount sufficient to cause precipitation hardening. However, when the amount of Hf contained in the alloy is more than 0.04% by weight, the alloy has poor ductility. Therefore, the amount of Hf to be contained in the alloy must be within the range of 0.004–0.04% by weight.

When the amount of oxygen contained in the alloy is more than 0.0015% by weight, the ductility of the alloy is poor. The amount of oxygen to be contained in the alloy must be not more than 0.0015% by weight.

When the amount of nitrogen contained in the alloy is more than 0.0010% by weight, the ductility of the alloy becomes very poor. Therefore, the amount of nitrogen to be contained in the alloy must be not more than 0.0010% by weight.

In the method of the present invention, when the raw material mixture is melted under a pressure of higher than $1\times10^{-4}$ mmHg, even if the melting is effected by electron beam, the amount of oxygen and nitrogen cannot be decreased. Therefore, the raw material mixture must be melted under a pressure of not higher than $1\times10^{-4}$ mmHg.

In the method of the present invention, when the raw material mixture is melted by an electron beam with an overall input energy of lower than 8 kw·hr/kg—Mo, even if the melting is effected under a pressure of not higher than $1\times10^{-4}$ mmHg, oxygen and nitrogen cannot be fully removed, and the alloy aimed in the present invention cannot be obtained. Therefore, the raw material mixture must be melted by the electron beam with an overall input energy of at least 8 kw·hr/kg—Mo.

As described above, according to the present invention, molybdenum is melted and refined by an electron beam with sufficient input energy under high vacuum, whereby the amounts of oxygen and nitrogen contained in the molybdenum can be noticeably decreased. Therefore, molybdenum oxide and molybdenum nitride, which are harmful to the ductility of molybdenum, are not formed in molybdenum. That is, zirconium and hafnium are effectively bonded to carbon to form their carbides. Accordingly, the high-temperature strength of molybdenum can be improved by the use of a very small amount of zirconium and hafnium, and the present invention is excellent in the material saving and recycling of the material.

What is claimed is:

1. A molybdenum base alloy having a high-temperature strength, which consists of 0.005–0.015% by weight of C, at least one of 0.002–0.02% by weight of Zr and 0.004–0.04% by weight of Hf, not more than 0.0015% by weight of oxygen, not more than 0.0010% by weight of nitrogen and the remainder being substantially Mo.

2. The alloy of claim 1 consisting of 0.010 wt % of carbon, less than 0.0005 wt % of oxygen, less than 0.005 wt % of nitrogen, 0.0067 wt % of zirconium, and the balance being molybdenum.

3. The alloy of claim 1 consisting of 0.006 wt % of carbon, less than 0.0005 wt % of oxygen, less than 0.0005 wt % of nitrogen, 0.0037 wt % zirconium, and the balance being molybdenum.

4. The alloy of claim 1 consisting of 0.007 wt % of carbon, 0.0009 wt % of oxygen, 0.0006 wt % of nitrogen, 0.027 wt % of hafnium, and the balance being molybdenum.

5. The alloy of claim 1 consisting of 0.009 wt % of carbon, 0.0011 wt % oxygen, less than 0.0005 wt % of nitrogen, 0.0043 wt % of zirconium, 0.010 wt % of hafnium, and the balance being molybdenum.

6. The alloy of claim 1 consisting of from 0.006 to 0.010 wt % of carbon, from 0.0037 to 0.0067 wt % of zirconium, from 0.0100 to 0.0280 wt % of hafnium, from 0.0005 to 0.0009 wt % of oxygen, and from 0.0005 to 0.0006 wt % of nitrogen.

* * * * *